United States Patent [19]

Capra et al.

[11] 4,167,941

[45] Sep. 18, 1979

[54] MECHANICALLY OPERATED DISPENSING DEVICE FOR INCREASING DISCHARGE PRESSURE AND DISPENSING TIME

[75] Inventors: Nicholas G. Capra, East Hanover, N.J.; Ronald L. Antenore, Coral Gables, Fla.

[73] Assignee: James D. Pauls, Ltd. (Limited Partnership), Miami, Fla.

[21] Appl. No.: 729,830

[22] Filed: Oct. 5, 1976

[51] Int. Cl.[2] ..... B05B 11/02

[52] U.S. Cl. ..... 128/251; 222/318; 222/321; 222/335; 222/340; 417/538

[58] Field of Search ..... 222/318, 335, 336, 340, 222/376, 383, 402.25, 424, 321, 396, 397; 239/321, 333; 417/538; 128/230, 234, 235, 251

[56] References Cited

U.S. PATENT DOCUMENTS

| | | | |
|---|---|---|---|
| 2,411,435 | 11/1946 | Kirschenbaum | 222/424 X |
| 2,461,121 | 2/1949 | Markham | 417/538 X |
| 2,545,319 | 3/1954 | Sundholm | 222/383 X |
| 2,580,188 | 12/1951 | Nilsen | 222/402.25 X |
| 3,471,065 | 10/1969 | Malone | 222/340 X |
| 3,746,261 | 7/1973 | Nazawa et al. | 239/333 |
| 3,777,945 | 12/1973 | Nozawa et al. | 222/394 |
| 3,790,034 | 2/1974 | Horvath | 239/333 X |
| 3,792,800 | 2/1974 | Capra et al. | 222/340 X |
| 3,797,748 | 3/1974 | Nazawa et al. | 239/321 |
| 3,799,448 | 3/1974 | Nazawa et al. | 239/321 |
| 3,921,861 | 11/1975 | Kondo | 222/340 X |
| 3,940,029 | 2/1976 | Horvath | 239/333 X |

*Primary Examiner*—Robert J. Spar
*Assistant Examiner*—Fred A. Silverberg
*Attorney, Agent, or Firm*—Dennis H. Lambert

[57] ABSTRACT

A dispensing device for discharging material under pressure, includes at least one accumulating chamber for receiving and accumulating material to be dispensed and operable to discharge the material under pressure over a sustained period of time for use as desired, and at least one expansible chamber operable to incrementally move material from a container into the accumulating chamber for storage of the material under pressure, whereby a prolonged, pressurized discharge of the material can be obtained.

24 Claims, 21 Drawing Figures

MECHANICALLY OPERATED DISPENSING DEVICE FOR INCREASING DISCHARGE PRESSURE AND DISPENSING TIME

BACKGROUND OF THE INVENTION

This invention relates to a mechanically operated dispensing device for discharging materials under pressure, and in a preferred form, relates to such devices for effecting a spray of the material.

In the prior art, many different types of dispensing devices are provided, and include aerosol operated spray discharge devices and pump operated spray discharge devices. Both of these prior art types of dispensers have disadvantages. For example, the aerosol type dispensers create a hazard to the environment and recent legislation has indicated that such aerosol operated devices may be outlawed in a few years due to the potential harm to the environment caused by the aerosol products used in such devices to effect discharge of the material. Additionally, aerosol operated devices must be specially constructed in order for the containers to withstand internal pressures, and a danger to children is created due to the likelihood of a small child operating the device and effecting discharge of a potentially harmful material into the face or eyes of the child. Aerosol operated dispensing devices further are limited in their use due to chemical incompatibility between the aerosol products and the material to be discharged.

Pump type dispensing devices, while not possessing the disadvantages that aerosol operated dispensing devices have, nonetheless are unsatisfactory for several reasons, including the fact that they are difficult and inaccurate to use, since the pressure generated for dispensing the material is effected by operating a plunger or trigger mechanism with the finger of the user. Further, pump type devices produce only a limited spray time, since each discharge of the material is accomplished with each operation of the plunger or trigger and the like, and thus repeated operation of the pump devices is sometimes necessary in order to effect discharge of a desired amount of material. Pump devices also present a danger to small children, since they may be inadvertently operated by a child, thereby effecting discharge of a potentially harmful substance.

The present invention solves the above problems of the prior art devices, and provides a simple and rugged structure which is capable of producing a relatively long and high pressure spray with only a single operation of a spray nozzle or actuator. Moreover, very little input pressure or torque is required in order to produce a much greater discharge pressure of the material, and in fact, the pressure of the material discharged may be regulated with some forms of the invention.

Still further, the structure of the present invention is such that danger to small children and the like is reduced because of the fact that dual manipulations are required in order to effect discharge of the material, and unique leak back provisions are made, whereby the pressurized contents of the discharge device are slowly permitted to leak back into the container, thus unloading the discharge reservoir, whereby subsequent actuation of the discharge nozzle or spray by an unsuspecting person will not effect an unexpected discharge of the material.

OBJECTS OF THE INVENTION

An object of the invention is to provide a mechanically operated dispensing device, wherein a relatively low input force effects a relatively high discharge pressure of material.

Another object of the invention is to provide a mechanically operated dispensing device, wherein a prolonged dispensing time is obtained with a single operation of a discharge nozzle or valve, whereby repeated operations of the discharge nozzle or valve are not necessary to effect discharge of a desired amount of material.

A further object of the invention is to provide a mechanically operated dispensing device, wherein accumulating means is provided for accumulating in increments an amount of material to be discharged under pressure, and wherein means is operable to effect continuous and selective discharge of the material from the accumulating means over a desired period of time with a substantially constant discharge pressure.

A still further object of the invention is to provide a mechanically operated dispensing device which includes accumulating means for accumulating material under pressure therein for discharge of the material over a prolonged period of time, and which includes provision for utilization of the device as a douche or enema, thereby enabling easy application of the douche or enema without the difficulty in applying and administering a douche or enema as experienced in many prior art devices.

Yet another object of this invention is to provide a mechanically operated dispensing device wherein a plurality of accumulating means are provided for accumulating different materials and means for releasing and mixing the materials from the accumulating means and discharge thereof under pressure over a desired prolonged period of time.

An even further object of the invention is to provide a mechanically operated dispensing device wherein first expansible chamber means are operable to pressurize and incrementally introduce a material to be dispensed into an accumulating chamber for accumulation of the material under pressure, and means operable to effect release of the accumulated pressurized material from the accumulating chamber, whereby a prolonged pressurized discharge of the material is obtained, with only a single operation of a spray nozzle or release valve.

Still another object of the invention is to provide a mechanically operated dispensing device including accumulating means for obtaining a substantially continuous prolonged pressurized discharge of material, and wherein the dispensing device may be readily attached to existing threaded bottles or containers and the like.

Another object is to provide a mechanically operated dispensing device which has means for accumulating and storing an amount of material under pressure for substantially continuous pressurized discharge of the material as desired, and wherein the device may be attached to a metal container or the like.

Still another object of the invention is to provide a mechanically operated dispensing device which is relatively simple and economical to make and which may be readily molded in a minimum number of parts and assembled at a minimum cost.

A still further object of the invention is to provide a mechanically operated dispensing device which includes means for accumulating material under pressure for discharge of the material, and wherein leak back means are provided in association with the accumulating means, whereby accumulated material is permitted to leak back into the container over a predetermined period of time to thereby eliminate the danger of an unsuspecting person effecting an unexpected discharge of material previously accumulated.

Yet another object of the invention is to provide a mechanically operated dispensing device, wherein an accumulating chamber is provided for incrementally accumulating an amount of material under pressure, whereby a substantially continuous uninterrupted discharge of the material under a substantially constant pressure over a prolonged period of time can be obtained, and wherein bypass means are provided in association with the accumulating means to thus prevent overpressurization of the accumulating means with the accumulated material.

Yet another object of the invention is to provide a mechanically operated dispensing device which includes a manually operable member accessible exteriorly of the device, said manually operable member being connected with first expansible chamber means to operate the expansible chamber means to incrementally charge an amount of material into an accumulating chamber for discharge of an accumulated amount of material over a prolonged period of time in a substantially continuous constant pressure spray, and wherein the manually operable means is stationary during discharge of material from the accumulating chamber.

DETAILED DESCRIPTION OF THE INVENTION

Figure 1:
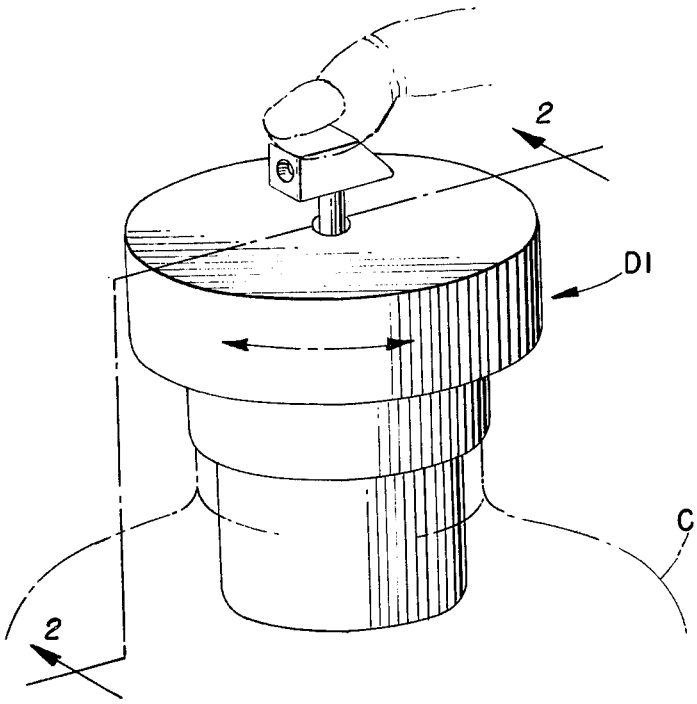
FIG. 1 is a fragmentary, top perspective view of a dispensing device in accordance with a first form of the invention.

Referring now more specifically to the drawings, wherein like reference numerals indicate like parts throughout the several views, a first form of dispensing device D1 is shown in FIGS. 1–5 and comprises a body member 10 having a generally disc-shaped base plate 11 with a depending annular skirt 12 thereon having internal threads 13 therein for cooperation with a threaded neck or top on a suitable container C. A first expansible chamber means 14 is formed integrally with the base plate 11 substantially centrally thereof on the upper surface of the base plate and includes oppositely outwardly opening cylindrical bores 15 and 16 defining first and second piston chambers having open outer ends and terminating at their inner ends in a dividing wall member 17 having a passageway 18 extending through the lower end thereof communicating at its opposite ends with the piston chambers 15 and 16. The partition 17 also has an elongate bore 19 extending upwardly therethrough in communication at its lower end with the passageway 18 and includes a diametrically enlarged portion 20 opening through the upper surface thereof.

The bore portions 19 and 20 define an upwardly facing shoulder 21 on which a spring means 22 is seated. An O-ring seal 23 is fitted in the bore 19 adjacent the lower end thereof for sealing engagement with a downwardly extending tubular member 24 of a discharge means 25. The tubular member 24 has a radially enlarged collar 26 thereon between the ends thereof which cooperates with the spring 22 to normally urge the discharge means 25 upwardly to the position shown in FIGS. 2 and 3. The tubular member 24 also has an elongate passageway 27 formed axially therethrough and terminating at its lower end spaced upwardly from the lower end of the tubular member and having transverse passages 28 in the tubular member communicating with the passageway 27 at the lower end thereof.

A pair of pistons 29 and 30 are reciprocably received in the piston chambers 15 and 16 and have rearwardly extending body portions 31 and 32 which are generally cross-shaped in cross-section and the body portions have cutaway sections 33 and 34 on the upper surfaces thereof on which upstanding posts 35 and 36 are respectively formed.

A manually operable, externally accessible operating or loading member or means 37 is secured to the body member 10 and includes a top wall 38 and a depending, annular peripheral side wall or skirt 39 projecting at its lower edge below the bottom surface of base plate or member 11. Suitable retaining means, such as snap ring 40 or the like, is engaged between the bottom edge of skirt 39 and base member 11 for retaining the operating or loading member in operative position on the dispensing device. The operating member is rotatable relative to the body member 10 and has a downwardly projecting, undulating formation 41 on its undersurface, with a correspondingly shaped undulating channel or cam track 42 formed in the undersurface thereof. The upstanding posts 35 and 36 on the pistons 29 and 30 are engaged in the cam track 42, whereby rotation of the operating member 37 effects reciprocating movement of the pistons 29 and 30 to alternately draw material from the container C into the piston chambers 15 and 16 and to then discharge the material therefrom into an accumulating chamber 43.

The accumulating chamber 43 is defined in a second expansible chamber means 44 comprising a cylindrical housing 45 having a top wall 46 received in a recess 47 in the underside of base 11 and suitably secured thereat as by an ultrasonic seal or cement or the like. The top wall 46 has a central opening 48 formed therethrough and a flexible flap valve 49 is secured to the underside of the top wall 46 in a position to overlie the opening 48 to close the opening against the pressure of material in the accumulating chamber 43, but openable upon movement of the tubular member 24 downwardly through the opening 48 into engagement with the flap valve 49. An O-ring seal 50 is positioned in the opening 48 at the juncture or separating line between top wall 46 and base 11 for sealing engagement with the sides of the tubular member 24 when it is extended through the opening 48 to prevent escape of material past the tubular member 24. In the downward position of the tubular member 24, the transverse passage 28 therein is disposed below the O-ring 50, whereby material in the accumulating chamber 43 is enabled to escape upwardly through the tubular member and outwardly through the discharge device 25. A bottom wall 51 is suitably sealed in place on the lower end of cylindrical housing 45 and the bottom wall has an opening 51*a* formed through the center thereof. A piston 52 is slidably reciprocably received in the housing 45 and biasing means, such as coil spring 53, is engaged between the bottom wall 51 and the under side of piston 52, urging the piston upwardly, whereby material in the accumulating chamber 43 is pressurized. A blowby channel or passage 54 is formed in the interior surface of the side wall of cylindrical housing 45 and extends through bottom wall 51 upwardly to a location spaced just above the upper surface of piston 52 when the piston 52 is in its lowermost position, whereby the accumulating chamber cannot be overcharged or overfilled with material. In other words, as the operating member 37 is rotated to effect reciprocation of the pistons 29 and 30, material is incrementally charged into the accumulating chamber, gradually moving the piston 52 downwardly, and when the piston 52 reaches its lowermost position, any additional material charged into the accumulating chamber will bypass the piston through the channel 54 and return to the container.

Figure 3:
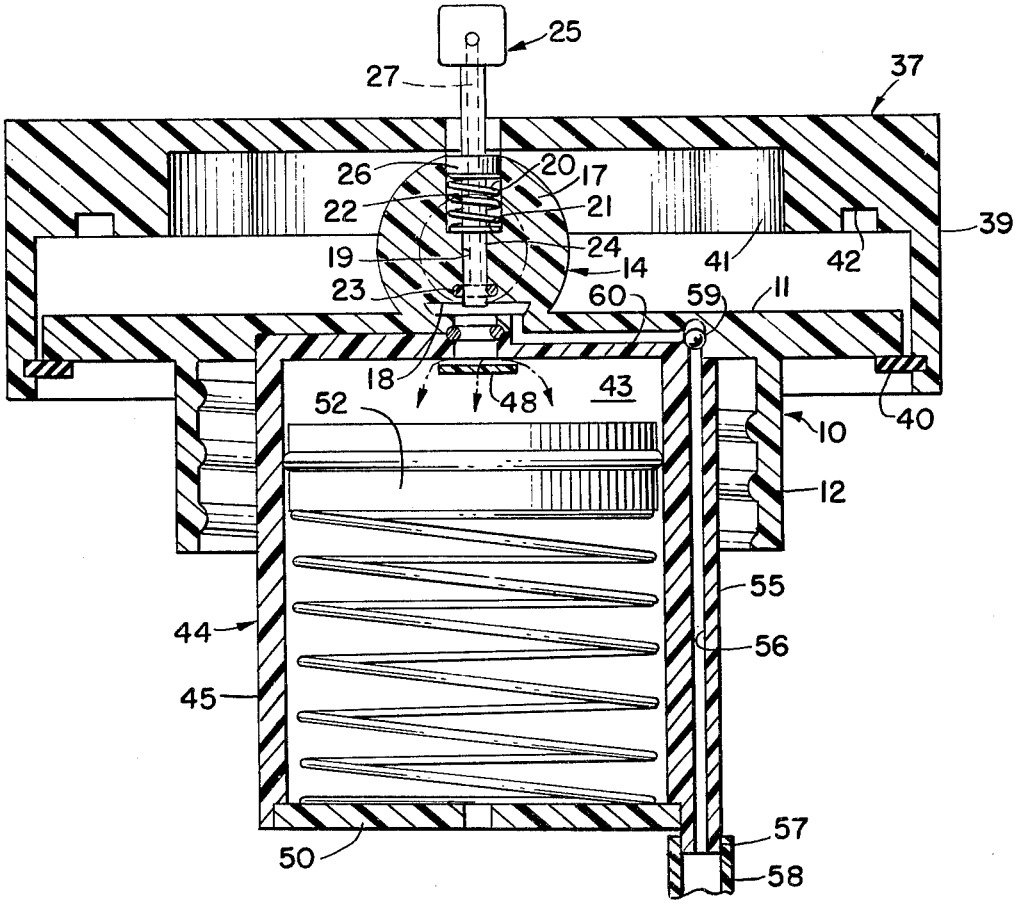
FIG. 3 is an enlarged sectional view taken along line 3—3 in FIG. 2.
Figure 4:
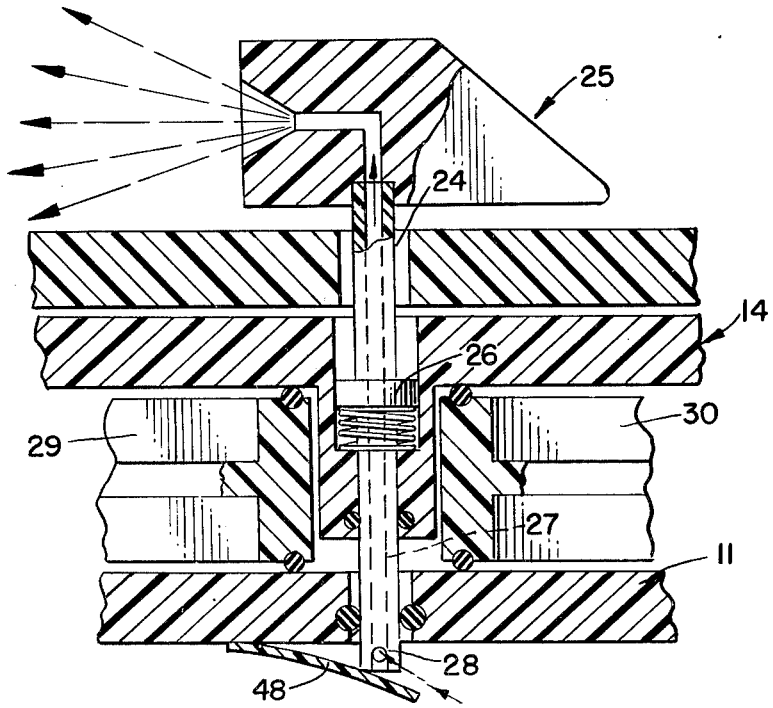
FIG. 4 is a greatly enlarged fragmentary sectional view, with portions broken away, of a portion of the discharge mechanism used with the device of FIGS. 1–3.
Figure 5:
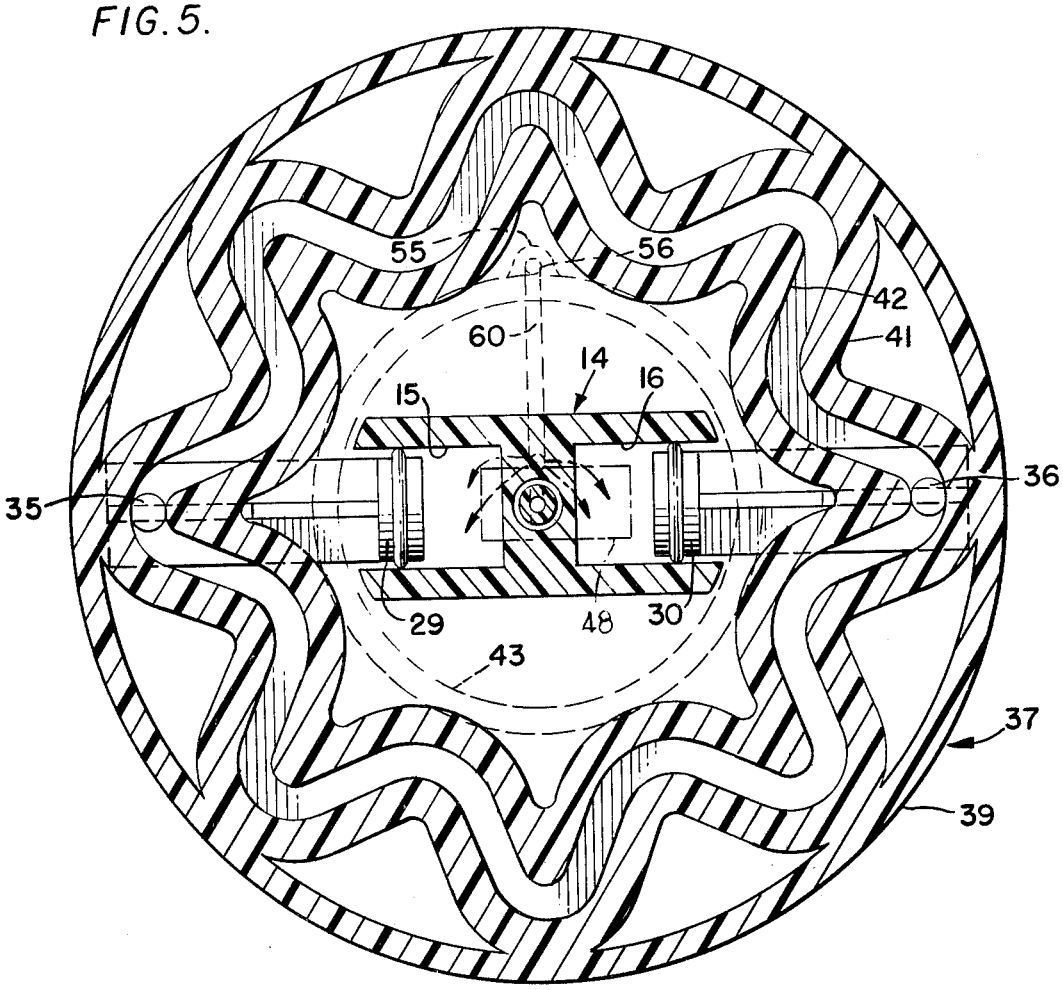
FIG. 5 is a view in section taken along line 5—5 in FIG. 2.

Further, as seen in FIGS. 3 and 5, an enlargement 55 is formed axially along one side of the cylindrical housing 45 and a passageway 56 extends therethrough. The enlargement projects downwardly at its lower end 57 below the bottom wall 51 of expansible chamber means 44 and a tube or the like 58 is received thereon. The tube 58 extends to adjacent the bottom of container C for receiving material therefrom. A check valve 59 is provided at the upper end of passage 56 and prevents reverse flow into passage 56 from a laterally extending passage 60 communicating at one end with the passage 56 and at its other end with the passage 18. Accordingly, when the pistons 29 and 30 are reciprocated outwardly, the piston chambers 15 and 16 are enlarged, thereby drawing material upwardly through tube 58 and passage 56 past check valve 59 and through passage 60 into passage 18 into the piston chambers. Subsequent reciprocation of the pistons in an inward direction pressurizes the material in the piston chambers, forcing it downwardly through opening 48 and past flap valve 49 into the accumulating chamber 43.

Figure 2:
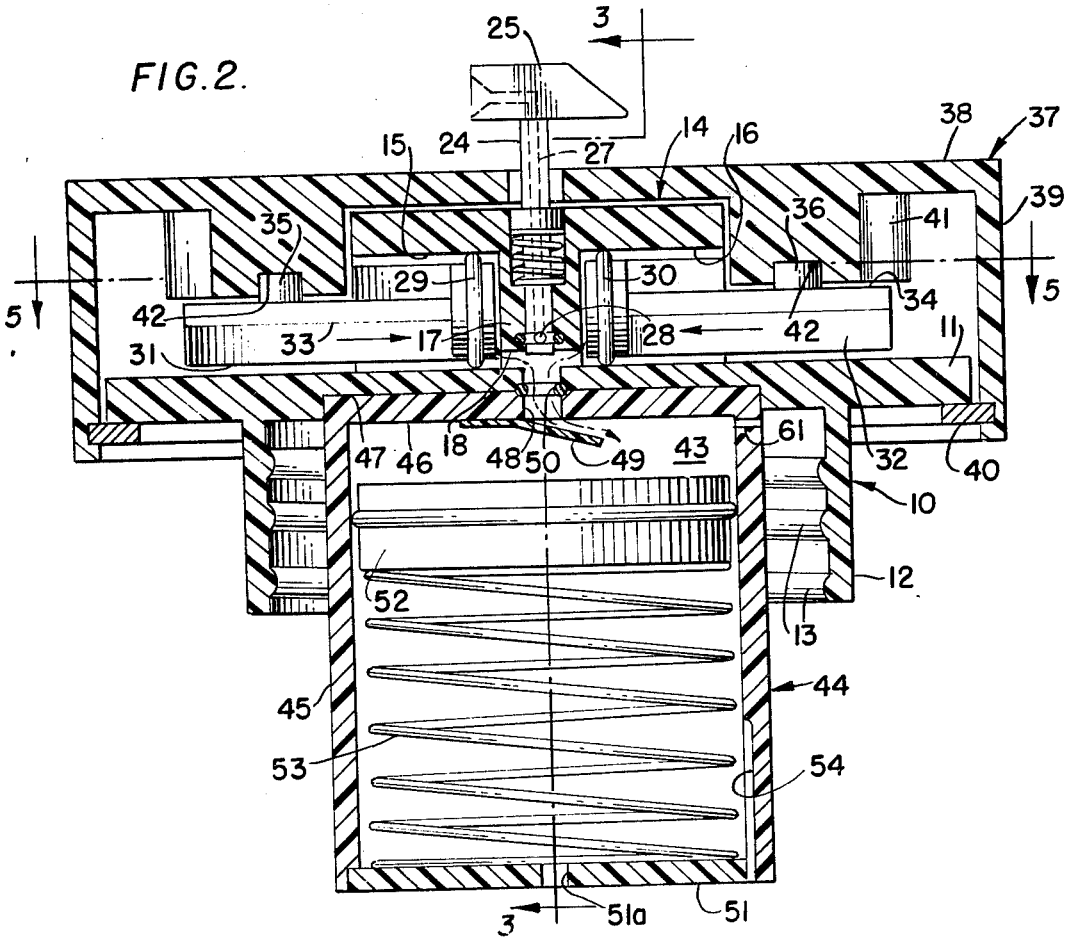
FIG. 2 is an enlarged sectional view taken along line 2—2 in FIG. 1.

If desired, a bleed opening 61 may be provided in the side wall of cylindrical housing 45 adjacent the upper end thereof, as viewed in FIG. 2, to enable slow leak back of material from accumulating chamber 43 into the container. This feature ensures that the material will not be retained in the accumulating chamber 43 for long periods of time, whereby an unsuspecting person might pick up the container with the dispensing device thereon and press the discharge means 25 and thereby effect an unexpected discharge of material from the accumulating chamber. The opening 61 is dimensioned such that it does not enable sufficient leak back during normal operation to interfere with the discharge time or pressure of material from the accumulating chamber, but it does enable leak back of material in the event the accumulating chamber is charged and the contents thereof are not dispensed at that time.

Figure 6:
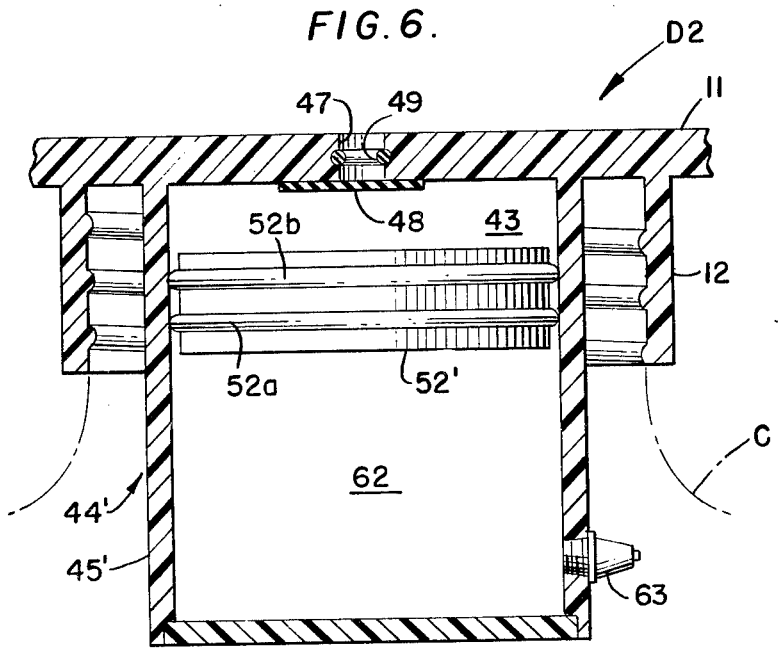
FIG. 6 is an enlarged fragmentary sectional view in elevation of a portion of a first modified form of dispensing device in accordance with the invention, wherein a gaseous fluid or material is used as the pressurizing medium in the accumulating chamber.

A first modification of the invention is indicated generally at D2 in FIG. 6 and portions of the device D2 have been removed for clarity of illustration. The structure and operation of the device D2 are substantially the same as that described in reference to FIGS. 1–5, except that the piston 52′ has a pair of sealing rings 52*a* and 52*b* thereon and rather than a coil spring in the housing 45′, the expansible chamber means 44′ utilizes a pressurized fluid such as air or the like in a chamber 62 for urging the piston 52′ upwardly. A suitable fitting 63 may be provided for charging the biasing chamber 62 prior to assembly of the device D2.

In connection with this form of the invention, it should be noted that seal ring 52*a* on the piston 52′ seals the pressurized gaseous fluid in chamber 62, while seal ring 52*b* seals the material in accumulating chamber 43.

Figure 7:
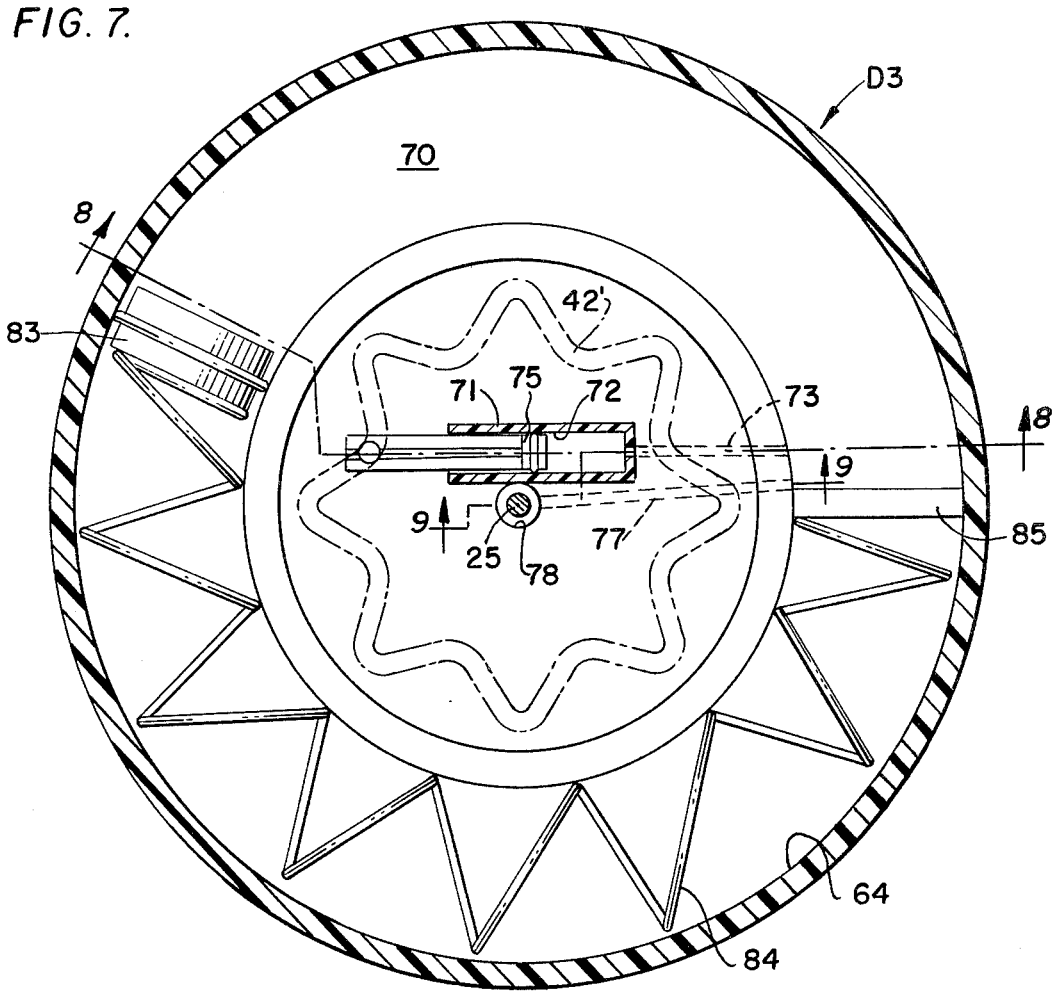
FIG. 7 is an enlarged view in section similar to FIG. 5 of a second modification of the invention, wherein the accumulating chamber is annular.
Figure 9:
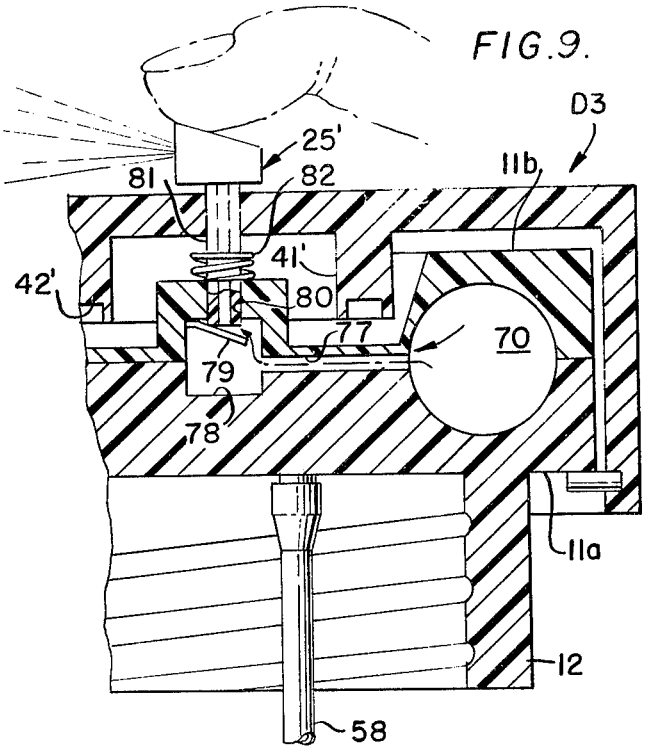
FIG. 9 is a fragmentary enlarged view in section taken along line 9—9 in FIG. 7.
Figure 8:
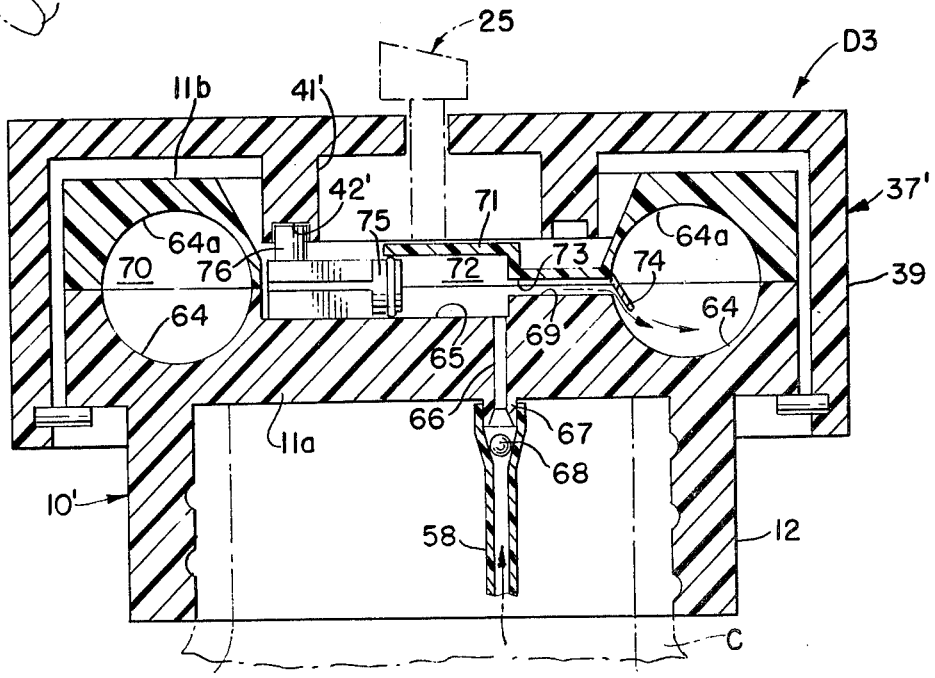
FIG. 8 is an enlarged view in section taken along line 8—8 in FIG. 7.

A second modification of the invention is illustrated in FIGS. 7, 8 and 9 and is indicated generally at D3, and comprises a body member 10', including a base 11*a* having an internally threaded depending cylindrical wall 12 for attachment to a container C. The upper surface of the base 11*a* has a semi-cylindrical circumferential channel 64 formed therein and a transversely extending semi-cylindrical cavity or chamber 65 disposed radially inwardly of the channel 64 and communicating at one end with an axially extending bore 66 which opens through a downwardly extending projection 67 inwardly of the cylindrical wall 12 for receipt of a tube 58 thereover. A check valve 68 is associated with the tube 58 and projection 67 for preventing backflow from passage 66 through tube 58. A semi-cylindrical groove 69 communicates at one end with the semi-cylindrical cavity 65 and at its other end with the channel 64.

The body member 10' also includes a top body portion 11*b* suitably secured and sealed to the base 11*a* and having a mating, complemental, semi-cylindrical, circumferential channel 64*a* therein, which defines with the channel 64 in base 11*a* a cylindrical, circumferential accumulating chamber 70. The top body member 11*b* also has an integrally formed, semi-cylindrically shaped structure 71 which cooperates with semi-cylindrical cavities or channels 65 and 69 to define a cylindrical piston chamber 72 and passage 73. A flap valve 74 is suitably secured to the body member 10' in overlying relationship to the end of passage 73 opening into accumulating chamber 70 to permit flow from piston chamber 72 into accumulating chamber 70 but prevent reverse flow therethrough.

A piston 75 is reciprocable in piston chamber 72 and includes an upstanding post 76 engaged in a cam track 42' formed in the undersurface of an undulating, downwardly projecting wall 41' on the undersurface of operator 37' and spaced radially inwardly of the annular accumulating chamber 70.

As seen in FIGS. 7 and 9, a passage 77 extends from accumulating chamber 70 to a cavity 78 in which a flap valve 79 is secured in normally closing relationship to an opening 80 through which a stem 81 of discharge device 25' extends. A spring 82 is engaged with the stem 81 to normally urge it upwardly. A piston 83 is reciprocable in accumulating chamber 70 and is biased in a first direction by spring 84 in a direction to reduce the size of accumulating chamber 70. A partition or dividing wall 85 is formed in the chamber 70 and with the piston 83, define the opposite ends of the chamber. Thus, in use, the operating member 37' is rotated to effect reciprocation of piston 75 in piston chamber 72 and draw material up through tube 58 past check valve 68 and through passage 66 into piston chamber 72. Continued rotation of operator 37' moves the piston 75 to reduce the size of chamber 72, thereby forcing the material through passage 73 and past flap valve 74 into accumulating chamber 70. Continued rotation of operator 37' effects continued reciprocation of piston 75, thereby charging material into the accumulating chamber in increments and gradually storing or accumulating a quantity of material therein. Thereafter, the discharge means 25 is depressed, causing stem 81 to move downwardly and opening flap valve 79, enabling the pressurized material to escape from accumulating chamber through passage 77 and up through the bore in stem 81.

Figure 10:
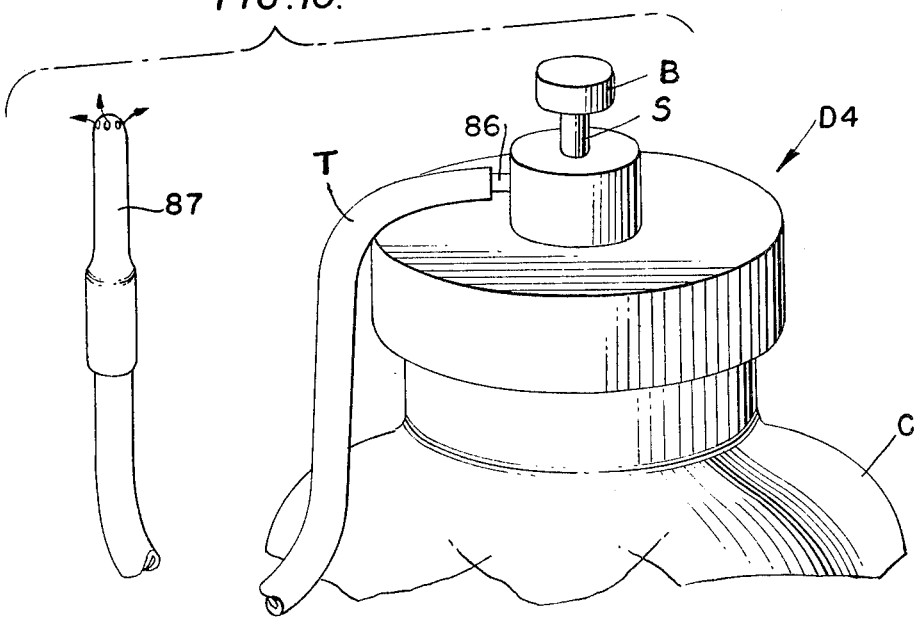
FIG. 10 is a fragmentary perspective view, with portions broken away, of a third modification of the invention, wherein a catheter for use in administering a douche or enema or the like is attached to a discharge fitting for receiving pressurized material from the accumulating chamber.

In FIG. 10 a third form of the invention is indicated generally at D4 and utilizes essentially the identical operating structures of either of the previously described forms of the invention. However, in this form of the invention, rather than a discharge nozzle 25 or 25', as previously described, a valve operating button B has a stem S extended into the dispensing device to open the flap valve and a tube T is connected with an outlet fitting 86 to convey the pressurized fluid to a catheter 87 for use as desired.

For example, the invention may be used to administer a douche or enema, and in this connection, the discharge pressure may be regulated with suitable conventional means provided either in the tube T or by fixed means in the fluid passages in the dispensing device to control the pressure to a suitable level, as, for example, that equivalent to three or four feet of head of water.

Figure 11:
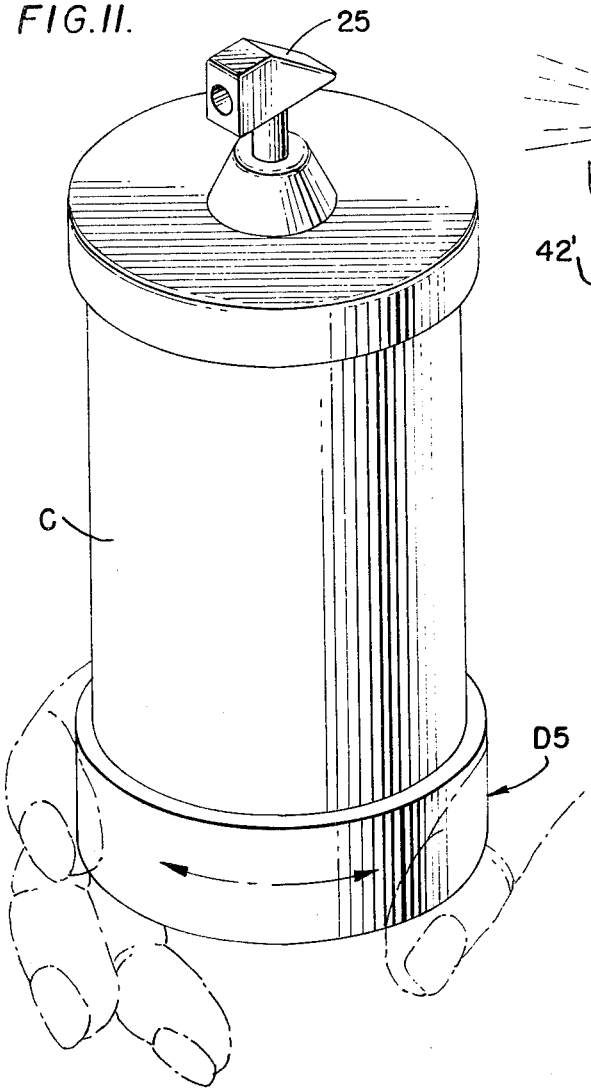
FIG. 11 is a perspective view of a fourth modification of the invention, wherein the manually operable means for loading the accumulating chamber is on the bottom end of a container.

In FIG. 11 a further form of the invention is indicated generally at D5, and utilizes essentially the same operating structure as that previously described, except that rather than being positioned at the top of the container, the dispensing device is positioned on the bottom of the container. An elongate tube (not shown) may extend from the discharge mechanism 25 to adjacent the bottom of the container, much as in the embodiment of the invention illustrated in FIG. 7 in co-pending application Ser. No. 724,006, filed Sept. 16, 1976.

Figure 12:
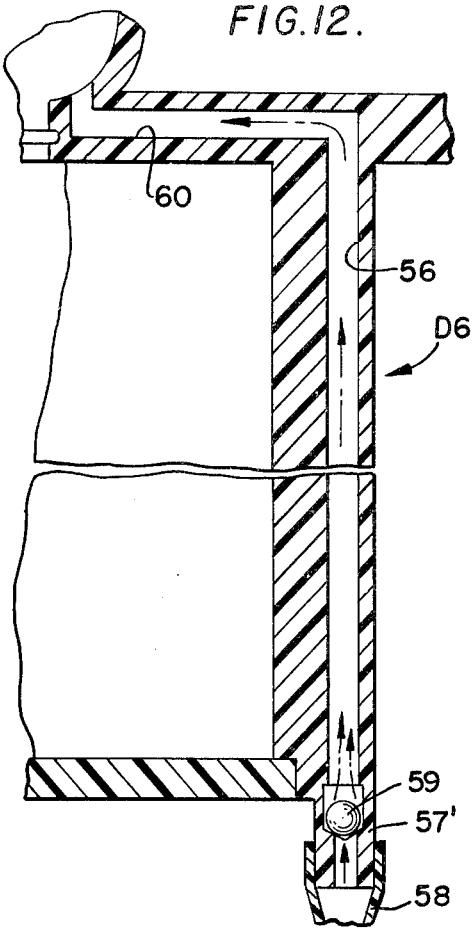
FIG. 12 is a greatly enlarged fragmentary sectional view of a fifth modification of the invention, and is a variation of the intake valve means of FIG. 3, and in the form of the invention in FIG. 12, the intake valve is disposed adjacent the bottom of the accumulating chamber rather than the top, as in FIG. 3.

FIG. 12 illustrates a fifth modification of the invention and is substantially identical to FIG. 3, except that rather than the check valve 59' being positioned at the upper end of passage 56, it is positioned at the lower end thereof in the projection 57'.

Figure 15:
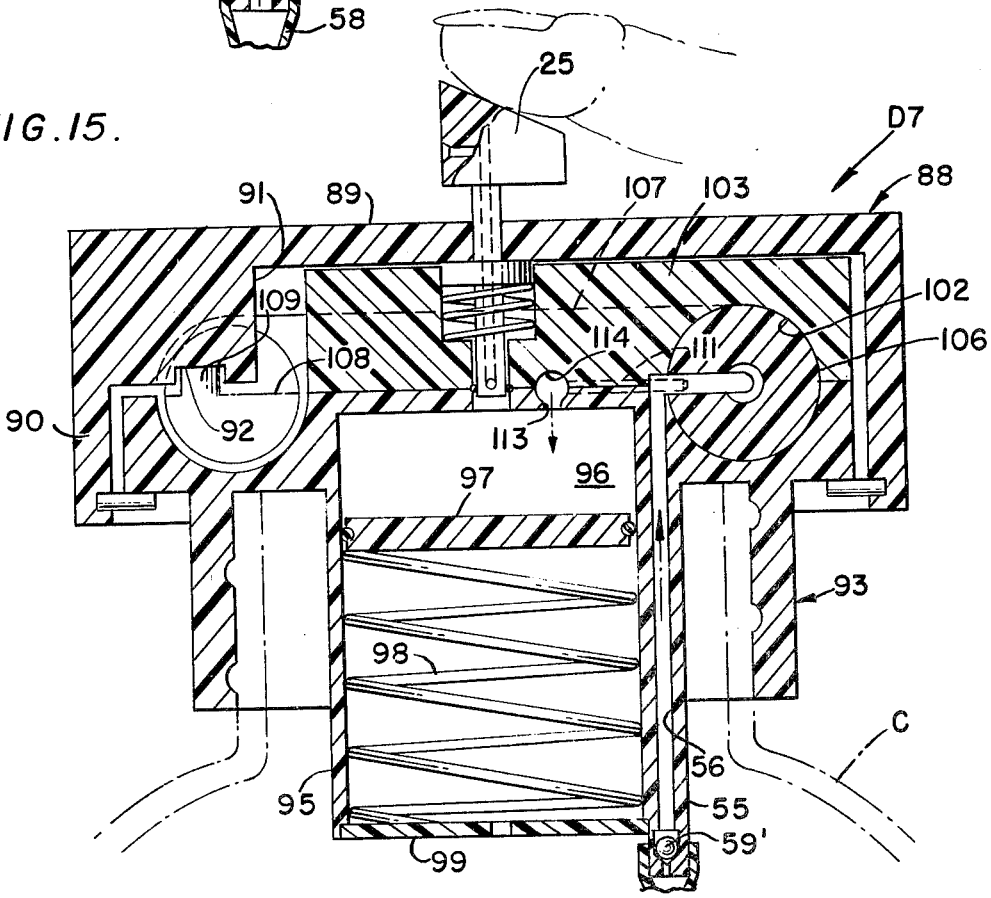
FIG. 15 is an enlarged fragmentary view in section taken along line 15—15 in FIG. 13.
Figure 13:
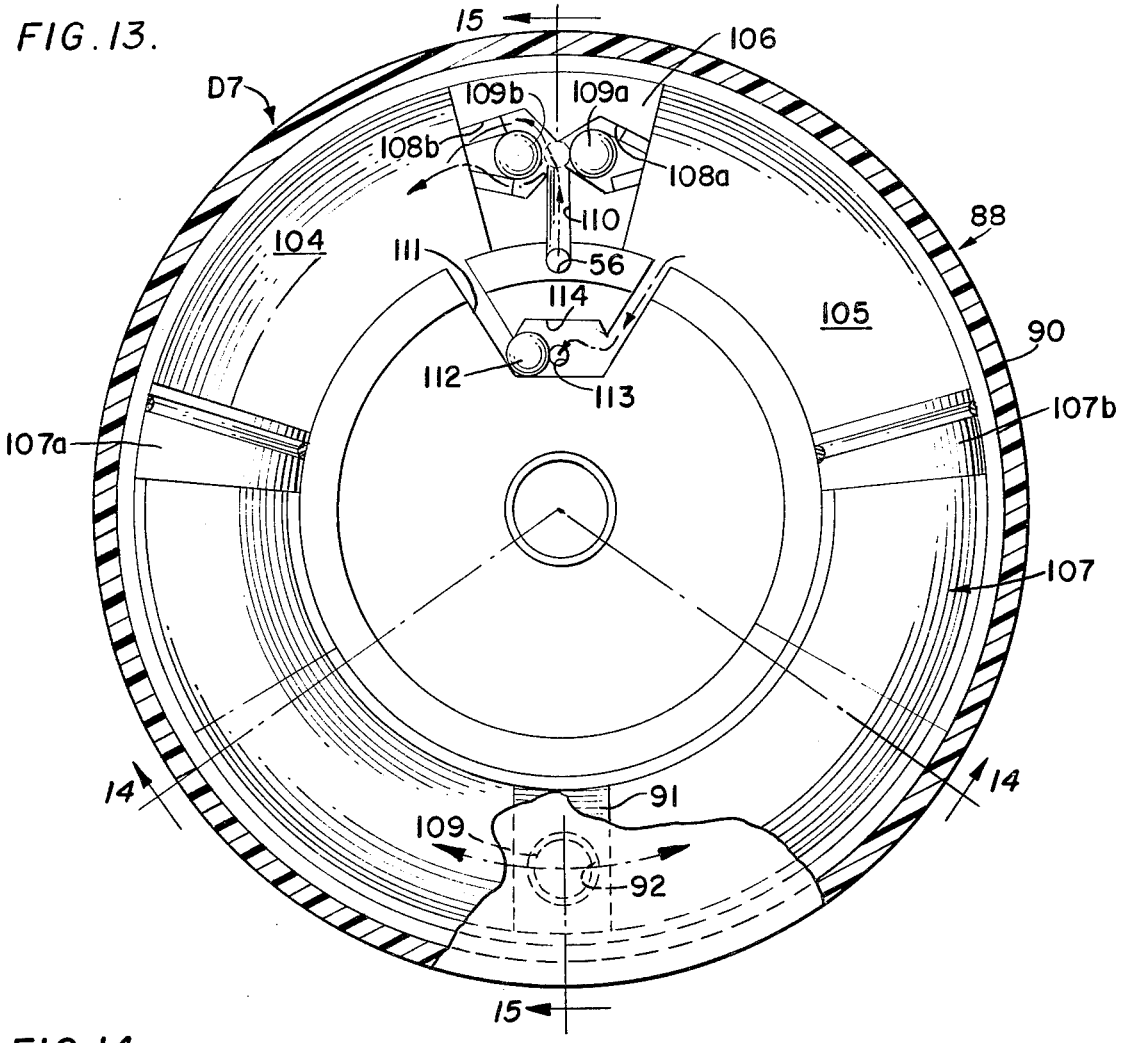
FIG. 13 is a vertical sectional view similar to FIG. 7 of a sixth form of the invention, wherein a single double-ended piston is provided in an annular chamber for to-and-fro reciprocation to alternately charge and discharge material into and from the respective piston chambers, whereby an accumulating chamber is incrementally charged by effecting a back and forth motion of the manually operable loading means.
Figure 14:
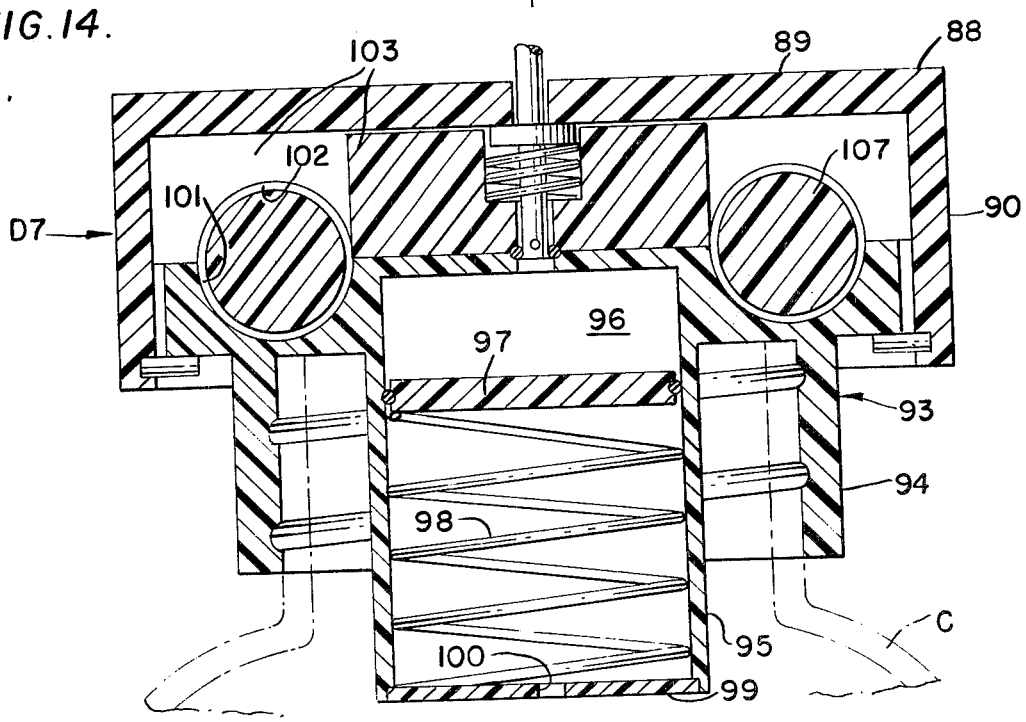
FIG. 14 is a view in section taken along line 14—14 in FIG. 13.

A sixth modification of the invention is indicated generally at D7 in FIGS. 13 and 14 and 15, and comprises an inverted, generally cup-shaped actuating or loading member 88 having a top wall 89 and depending, cylindrical side wall 90. A downwardly projecting web or wall 91 is formed in the interior of the actuator 88 at one side thereof, and has a socket or recess 92 formed in the underside thereof. A body member 93 has a depending cylindrical wall 94 internally threaded for cooperation with mating threads on a container C and has a depending cylindrical wall 95 spaced radially inwardly of the wall 94 defining an accumulating chamber 96. A piston 97 is reciprocable in the accumulating chamber and is urged upwardly by a spring 98 to reduce the size of the chamber 96. A closure wall 99 is secured at the bottom end of wall 95 and has a central opening 100 therethrough.

The upper surface of body member 93 has a semi-cylindrical arcuate channel 101 formed therein, which cooperates with a similarly formed semi-cylindrical channel 102 in an upper body portion 103 to define a pair of cylindrical, arcuately shaped piston chambers 104 and 105 on opposite sides of a septum or dividing wall 106, disposed substantially diametrically opposite the web or projection 91 on the operator 88.

A semi-circular, double-ended piston 107 is reciprocably positioned in the circular chamber defined by top and bottom body portions 103 and 93 and has a cutout area 108 intermediate the ends thereof with an upstanding post 109 thereon received in the socket 92 in the web 91 of operator 88, whereby rotary motions of the operator 88 in opposite directions effects reciprocating movement of the piston 107 in the respective piston chambers 104 and 105, such that the piston heads 107*a* and 107*b* are operative to alternately draw material into the respective piston chamber and then discharge it therefrom.

In this connection, a passage 56 is formed through an enlargement 55 on one side of the accumulating chamber housing 95 and a valve 59' is provided therein, such that when piston 107 is reciprocated in a first direction, as, for example, in a clockwise direction when viewed in FIG. 13, piston head **107*b* moves to enlarge piston chamber 105, creating a suction in valve chamber 108*a*, moving valve 109*a* from its seat and establishing communication with passage 110 and passage 56, whereby material is drawn upwardly through passage 56 and past valve 109*a* into piston chamber 105. Simultaneously with this action, the piston head 107*a* is moving toward the septum 106, reducing the size of piston chamber 104, creating a pressure therein and moving valve 109*b* in valve chamber 108*b* to its seat, thereby interrupting or blocking communication between piston chamber 104 and passages 110 and 56. However, the pressure is communicated through passageway 111, whereby valve 112 is moved to the right, establishing communication between passage 111 and passage 113 in chamber 114, whereby the material previously drawn into piston chamber 104 is discharged through passages 111 and 113 into the accumulating chamber 96. Upon movement of the piston 107 in the opposite or counterclockwise direction, flow occurs as indicated by the arrows in FIG. 13; therefore, alternate rotary movements of the operator 88 in opposite directions effects to and fro reciprocating movement of the piston 107 to incrementally charge the material into the accumulating chamber 96 for discharge thereof through the discharge means 25**.

Figure 18:
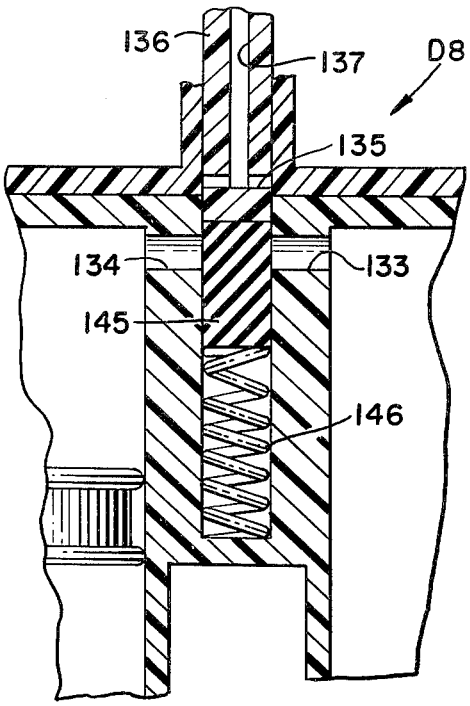
FIG. 18 is a greatly enlarged fragmentary view in section taken along line 18—18 of FIG. 17.
Figure 16:
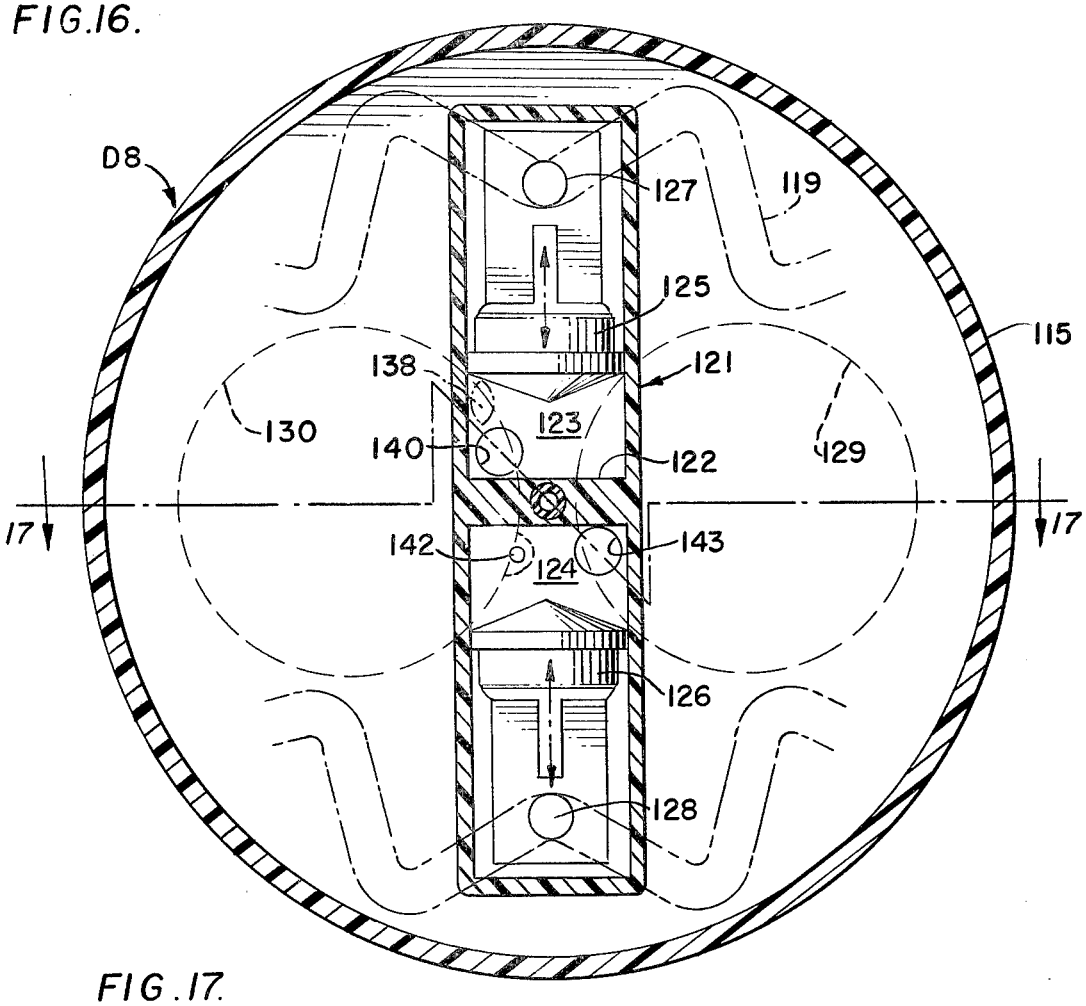
FIG. 16 is a view in section similar to FIG. 13 of a seventh form of the invention, wherein a plurality of accumulating chambers are provided for accumulating diverse materials.
Figure 17:
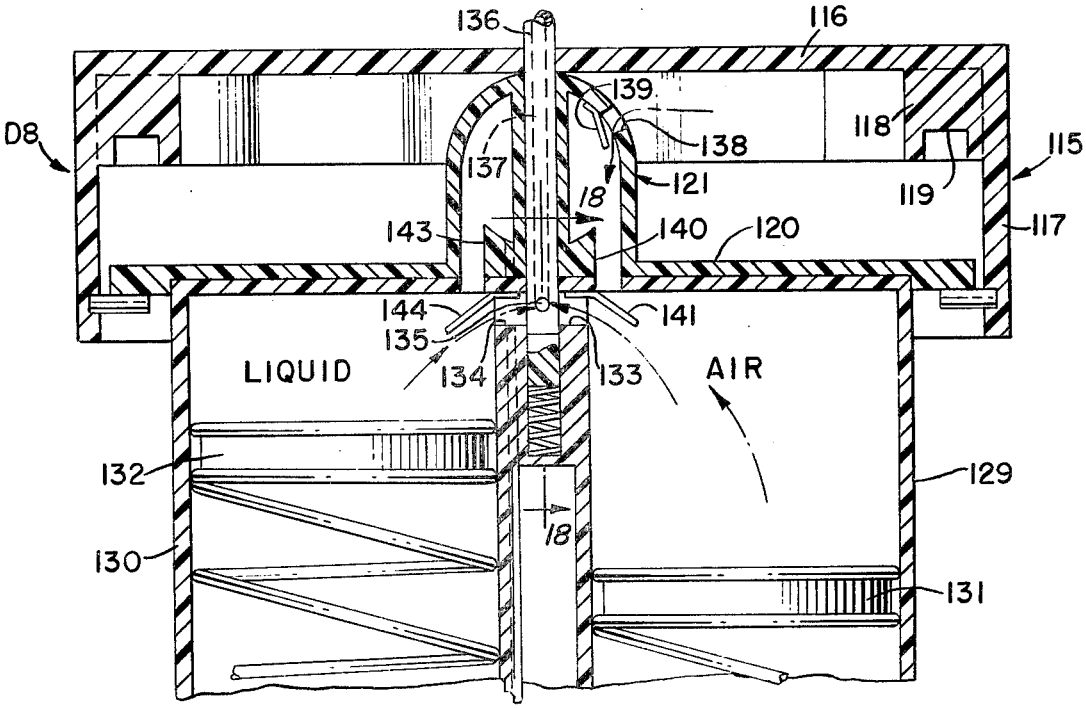
FIG. 17 is an enlarged fragmentary view in section taken along line 17—17 in FIG. 16.

A seventh form of the invention is indicated generally at D8 in FIGS. 16, 17 and 18. In this form of the invention, a generally cup-shaped inverted operator 115 has a top wall 116 and a depending side wall 117 and a downwardly projecting, undulating formation 118 is formed in the interior of the operator 115 adjacent the upper edge of side wall 117 and has a correspondingly shaped cam track or channel 119 formed in the undersurface thereof. A bottom plate 120 is assembled to the operator 115 and has an upstanding, elongate formation 121 formed generally diametrically thereof and has a septum or dividing wall 122 intermediate the ends thereof defining a pair of opposite piston chambers 123 and 124. Pistons 125 and 126 are reciprocable in the piston chambers 123 and 124 and have upstanding posts 127 and 128 thereon, respectively, engaged in the cam track 119, whereby rotation of the operator 115 effects simultaneous reciprocation of the pistons 125 and 126. A pair of similar accumulating chambers 129 and 130 are formed as a unit and are suitably secured and sealed to the underside of base 120, and the accumulating chambers 129 and 130 have pistons 131 and 132 reciprocable therein, respectively. The chambers 129 and 130 communicate at their upper ends with passages 133 and 134, respectively, which are selectively placed in communication with a transverse opening 135 in discharge stem 136. A bore 137 extends through the discharge stem and is in communication with the passage 135, whereby the materials in the respective accumulating chambers 129, 130 enter the passage 135 and are admixed and flow through the passage 136 for discharge as desired. An example of a particular use for the apparatus described in these figures is for dispensing shave cream, wherein a liquid is mixed with air to effect foaming action.

Air is drawn into piston chamber 123 through an opening 138 in the structure 121 and the opening 138 is closeable by a flap valve 139 when the piston 125 is moved to reduce the size of piston chamber 123. The air in piston chamber 123 is discharged through opening 140 and past flap valve 141 into the accumulating chamber 129. Similarly, liquid is drawn into piston chamber 124 through passage 142 and is discharged therefrom through opening 143 past flap valve 144.

As seen best in FIG. 18, the discharge stem 136 has a valve plug or closure 145 on the lower end thereof which is sized to close the openings 133 and 134 when the stem is in the up or non-discharge position.

Figure 19:
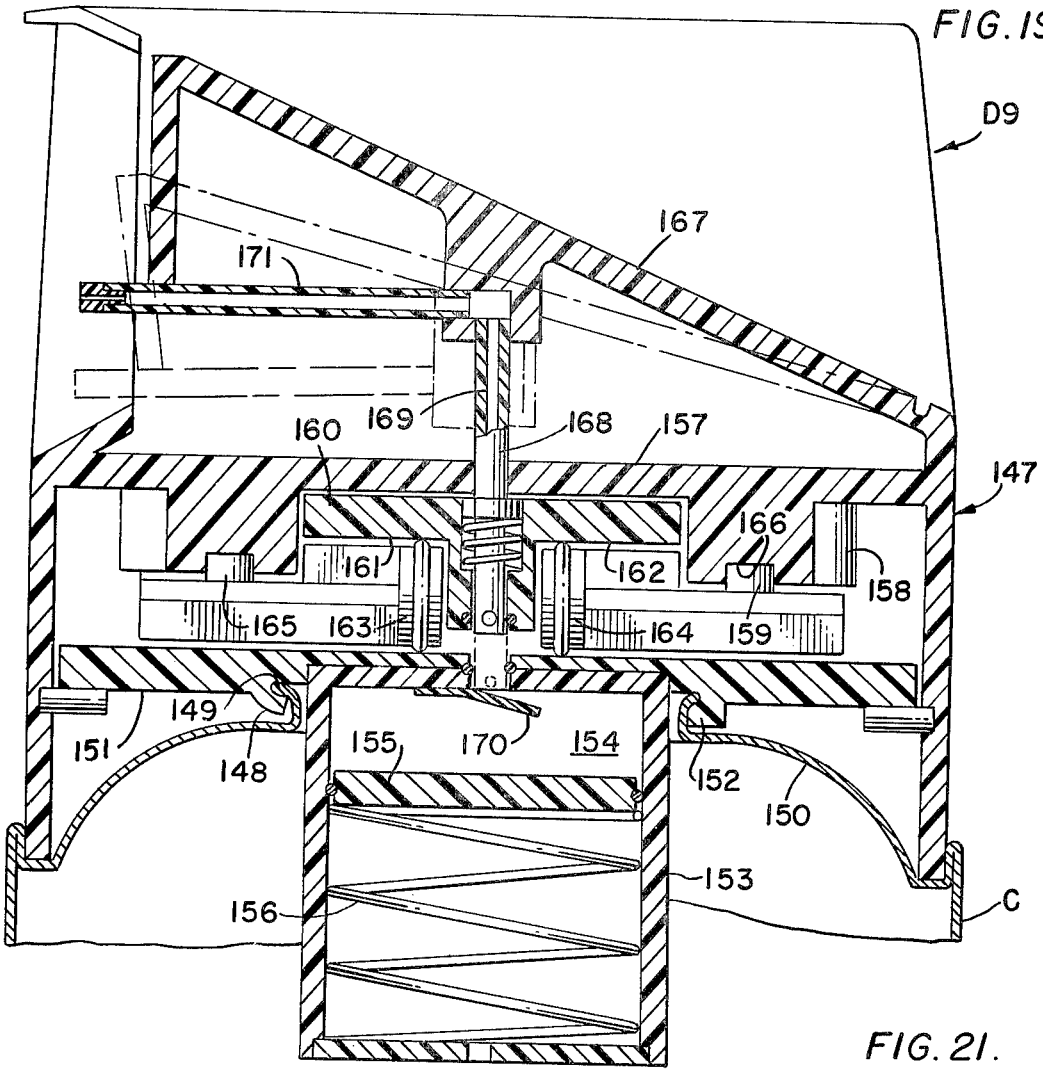
FIG. 19 is an enlarged fragmentary view in section similar to FIG. 15 of an eighth form of the invention, wherein an overcap arrangement has the charging expansible chamber means therein and is attached by a crimped arrangement to a metal or like container.

An eighth form of the invention is indicated generally at D9 in FIG. 19 and is similar to that form of the invention illustrated in FIG. 10 in co-pending Application Ser. No. 724,006, in that it comprises an overcap arrangement 147 secured to a container C of metal or the like by means of a heat sealed depending cylindrical wall 148 attached to an annular bead 149 on the container top wall 150. The wall 148 is formed on a base plate 151, which is assembled to the overcap 147 and the base plate 151 is secured against relative rotation by a key 152, whereby relative rotation between the base 151 and container C is prevented, but rotation between the cap 147 and base plate 151 is permitted.

A cylindrical housing 153 is suitably secured to the underside of base 151 and defines an accumulating chamber 154 therein and includes a piston 155 urged upwardly by a spring 156. A cam plate 157 is formed integrally with the cap 147 and has a downwardly projecting undulating formation 158 formed on the underside thereof with a cam track 159 formed therein. The base plate 151 also has an upstanding, cylindrical structure 160 thereon defining a pair of piston chambers 161 and 162 in which pistons 163 and 164 are reciprocably received. The pistons 163 and 164 have upstanding posts 165 and 166 thereon received in the cam track 159, whereby rotation of the cap 147 effects reciprocation of the pistons 163 and 164. The cap also includes a depressable button or top wall portion 167 which has secured thereto an actuating stem 168 with an axial passage 169 formed therethrough, such that when the button 167 is moved downwardly, the stem 168 moves downwardly to a position indicated in dotted lines opening a flat valve 170 to enable escape of pressurized material from accumulating chamber 154 through the passage 169 and through a discharge nozzle 171.

Figure 20:
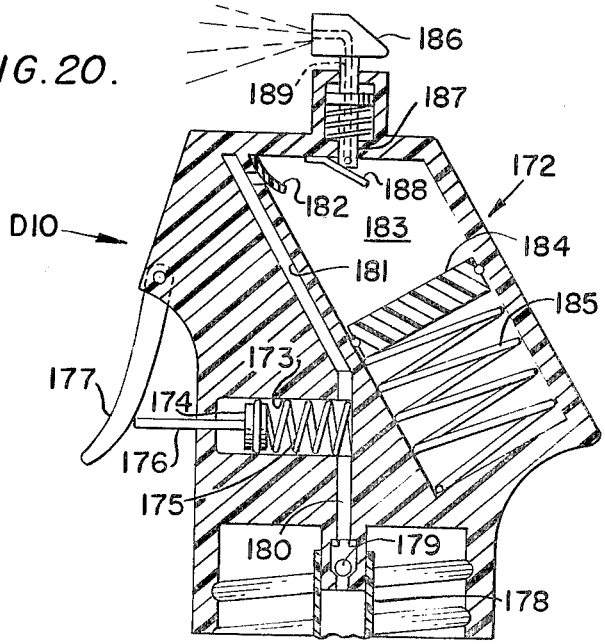
FIG. 20 is a fragmentary view in section similar to FIG. 19 of a ninth form of the invention, wherein the charging piston or expansible chamber is operated by a trigger mechanism.
Figure 21:
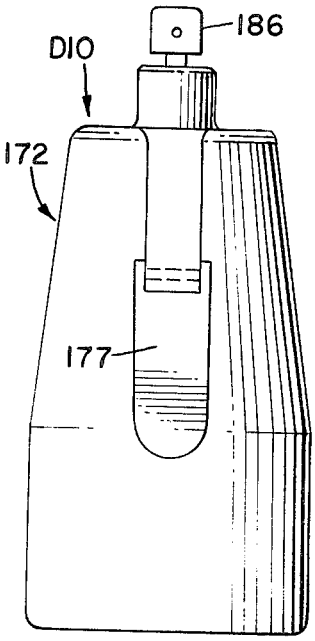
FIG. 21 is a front view in elevation of the device in FIG. 20.

In FIG. 20, a ninth form of the invention is indicated generally at D10 and in this form of the invention, a trigger operated mechanism 172 includes a piston chamber 173 formed therein in which a piston 174 is reciprocably mounted. The piston is urged outwardly by a spring 175 and a stem or pin 176 projects outwardly of the chamber 173 for cooperation with a trigger 177, whereby movement of the trigger 177 reciprocates the piston 174 in a direction to reduce the size of chamber 173. Release of the trigger enables the spring 175 to urge the piston 174 to the left, as viewed in FIG. 20, thereby drawing material upwardly through a tube 178 past a valve 179 and through a passage 180 into the piston chamber 173. Rearward movment of the trigger pressurizes the material in chamber 173, forcing it upwardly through a passage 181 and past a flap valve 182 into an accumulating chamber 183, thereby urging a piston 184 in the accumulating chamber downwardly against the bias of spring 185.

When it is desired to discharge the material from accumulating chamber 183, a discharge means 186 is depressed, moving a stem 187 downwardly to open a flap valve 188 and establishing communication between the accumulating chamber 183 and a passage 189 in the stem.

Additionally, and if desired, a fill opening may be provided anywhere on the container for refilling it with material when the contents have been exhausted. One specific example of a suitable fill opening and removable closure therefor is shown at 69, 70, 72 in FIG. 7 of co-pending application Ser. No. 724,006. Of course, the fill opening could be in the side, top or bottom of the container as desired; and any of the forms of the invention described herein could have such an opening.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A dispensing device, comprising:

a container for material to be dispensed;

a dispensing device carried by the container and including first manually operable means accessible exteriorly of the container;

at least one expansible accumulating chamber means carried by the dispensing device for receiving and storing under pressure a quantity of material to be dispensed and having a longitudinal axis;

at least one expansible charging chamber means carried by the dispensing device and connected with the container and with the accumulating chamber means for receiving material from the container, pressurizing it, and transferring it under pressure to the accumulating chamber means, said expansible charging chamber means having a smaller cross-sectional area transverse to the longitudinal axis than the expansible accumulating chamber means and repeatedly operable to incrementally introduce quantities of material into the accumulating chamber means to incrementally charge the accumulating chamber means with an amount of material to be dispensed;

second manually operable means connected with the expansible accumulating chamber means to effect prolonged pressurized discharge of material from the expansible accumulating chamber means; and said dispensing device comprising a base member having fastening means thereon securing the base member to the container against relative movement therebetween, said expansible accumulating chamber means carried by the base member, and said first manually operable means comprising a rotatable member carried by the base member for rotation relative thereto and connected with the expansible charging chamber means to effect operation thereof, said first and second manually operable means being normally independent of each other and the operation of one normally being free of movement or operation of the other, whereby the second manually operable means may be aligned for desired discharge of the material and the first manually operable means then operated without causing movement of or affecting the alignment of the second manually operable means.

2. A dispensing device as in claim 1, wherein the expansible chamber means includes a first movable member, the accumulating chamber means includes a second movable member, and the difference in transverse cross-sectional areas of the two chamber means results in a force multiplication for charging material into the accumulating chamber means from the expansible chamber means to thus produce a discharge force from the accumulating chamber means greater than the force required to operate the expansible chamber means to charge material into the accumulating chamber means, said accumulating chamber means having a larger volume than the expansible chamber means, whereby repeated operation of the expansible chamber means is required in order to fill the accumulating chamber means, and said second manually operable means is operable to effect a prolonged uninterrupted discharge of the accumulated material from the accumulating chamber means.

3. A dispensing device as in claim 2, wherein the expansible chamber means comprises an arcuately shaped cylinder extending around the axis of the dispensing device, a correspondingly arcuately shaped, double ended piston reciprocable in the cylinder, said first manually operable means connected with the piston to effect reciprocation of the piston, a dividing wall in the cylinder between the opposite ends of the piston defining with the piston a pair of chambers, whereby operation of the first manually operable means in alternate directions effects reciprocation of the piston in alternate directions to alternately draw material into one chamber and discharge material from the other chamber into the accumulating chamber means.

4. A dispensing device as in claim 2, wherein the expansible chamber means comprises at least one piston reciprocable in a cylinder, said first manually operable means is connected with the piston to effect reciprocation thereof.

5. A dispensing device as in claim 4, wherein a cam means is on the rotatable member, and means is on the piston engaged with the cam means whereby movement of the cam means effects reciprocation of the piston.

6. A dispensing device as in claim 5, wherein the second manually operable means comprises a discharge means having an elongate tubular member projecting downwardly into the dispensing device adjacent the expansible chamber means, said accumulating chamber means having an opening therein in aligned communication with the tubular member, valve closure means normally closing the opening, and said tubular member having a first position spaced from the valve closure means whereby material is retained in the accumulating chamber means and a second position extending into the accumulating chamber means into engagement with the valve closure means to open the valve closure means and enable escape of the material from the accumulating chamber means through the tubular member and to a point of use.

7. A dispensing device as in claim 5, wherein a pair of pistons are reciprocable in a pair of communicating cylinders, and each piston has means thereon engaged with the cam means to effect simultaneous reciprocation of the pistons.

8. A dispensing device as in claim 7, wherein said accumulating chamber means movable member comprises a piston reciprocable in a cylinder, and biasing means in the second expansible chamber means urging the piston in a direction to discharge material from the accumulating chamber means.

9. A dispensing device as in claim 8, wherein the biasing means comprises a coil spring.

10. A dispensing device as in claim 8, wherein the biasing means comprises a pressurized gaseous material.

11. A dispensing device as in claim 1, wherein the accumulating chamber means has bypass means associated therewith to prevent overpressurization of the accumulating chamber means.

12. A dispensing device as in claim 1, wherein the accumulating chamber means includes leak back means to enable slow leakage of material from the accumulating chamber means back to the container, whereby the accumulating chamber means will not hold a charge of material for a longer period of time than that normally encountered during a dispensing cycle.

13. A dispensing device as in claim 1, wherein one-way valve means are connected with the expansible chamber means and with the accumulating chamber means to control flow to and from the chamber means, whereby the expansible chamber means may be repeatedly operated to introduce successive charges of material into the accumulating chamber means and the material is retained in the accumulating chamber means.

14. A dispensing device as in claim 13, wherein a material discharge means is connected with the accumulating chamber means to effect discharge of material from the accumulating chamber means.

15. A dispensing device as in claim 14, wherein the discharge means is constructed to obtain uninterrupted discharge of all the material from the accumulating chamber means upon a single operation of the discharge means.

16. A dispensing device as in claim 1, wherein said accumulating chamber means includes a piston and cylinder carried by the base member, and said expansible chamber means comprises piston and cylinder means carried by the base member.

17. A dispensing device as in claim 16, wherein the fastening means comprises a threaded member for threaded cooperation with like threads on the container.

18. A dispensing device as in claim 16, wherein the accumulating chamber means piston and cylinder have their axis coincident with the container axis, and the accumulating chamber means piston and cylinder depend from the base member in a position to be disposed inside the container.

19. A dispensing device as in claim 16, wherein the accumulating chamber means piston and cylinder are disposed at the upper surface of the base member, said accumulating chamber means cylinder being arcuately shaped and extending circumferentially around the axis of the dispensing device.

20. A dispensing device as in claim 1, wherein a discharge fitting is connected with the accumulating chamber means to receive material discharged therefrom, and a catheter is connected with the discharge fitting to receive the material for use as a douche.

21. A mechanically operated dispensing device including at least one first expansible chamber means in fluid communication with material to be dispensed, at least one second expansible chamber means in communication with the first expansible chamber means for receiving material therefrom to accumulate and store the material under pressure, a discharge means in operative association with the second expansible chamber means to receive the material from the second expansible chamber means and to discharge it under pressure to a point of use, first manually operated means operatively connected with the first expansible chamber means to operate the first expansible chamber means to alternately draw material thereinto and discharge material under pressure therefrom into the second expansible chamber means, and said discharge means including a second manually operated means for effecting release of the pressurized material from the second expansible chamber means to a point of use, said first and second manually operated means being independent of each other and operation of one being free of movement or operation of the other, said first manually operated means comprising a rotatable member rotatable relative to the container and having cam means thereon for cooperation with the first expansible chamber means to effect multiple operations of said first expansible chamber means upon a single revolution of the first manually operated means, and said second expansible chamber means including means for relieving pressure therein above a predetermined value and means for slowly leaking pressure therefrom when the second expansible chamber means is pressurized with material but the material is not discharged therefrom.

22. A dispensing device, comprising:

a container for material to be dispensed;

a dispensing device carried by the container and including first manually operable means accessible exteriorly of the container;

at least one accumulating chamber means carried by the dispensing device for receiving and storing under pressure a quantity of material to be dispensed;

at least one expansible chamber means carried by the dispensing device and connected with the container and with the accumulating chamber means for receiving material from the container, pressurizing it, and transferring it under pressure to the accumulating chamber means, said expansible chamber means operable to repeatedly introduce quantities of material into the accumulating chamber means to incrementally charge the accumulating chamber means with an amount of material to be dispensed, and said first manually operable means being connected with the expansible chamber means to effect operation of the expansible chamber means;

second manually operable means connected with the accumulating chamber means to effect prolonged pressurized discharge of material from the accumulating chamber means;

said first manually operable means comprising a cam means; and said expansible chamber means comprising a pair of pistons reciprocable in a pair of communication cylinders, and each piston having means thereon engaged with the cam means to effect simultaneous reciprocation of the pistons.

23. A dispensing device, comprising:

a container for material to be dispensed;

a dispensing device carried by the container and including first manually operable means accessible exteriorly of the container;

at least one accumulating chamber means carried by the dispensing device for receiving and storing under pressure a quantity of material to be dispensed;

at least one expansible chamber means carried by the dispensing device and connected with the container and with the accumulating chamber means for receiving material from the container, pressurizing it, and transferring it under pressure to the accumulating chamber means, said expansible chamber means operable to repeatedly introduce quantities of material into the accumulating chamber means to incrementally charge the accumulating chamber means with an amount of material to be dispensed, and said first manually operable means connected with the expansible chamber means to effect operation of the expansible chamber means;

second manually operable means connected with the accumulating chamber means to effect prolonged pressurized discharge of material from the accumulating chamber means; and said accumulating chamber means having a larger transverse cross-sectional area than said expansible chamber means, whereby hydraulic multiplication is obtained from the expansible chamber means to the accumulating chamber means, said expansible chamber means being disposed with its longitudinal axis in a plane substantially perpendicular to the longitudinal axis of the container, whereby the expansible chamber means occupies a minimum distance along the axis of the container, and the container height or length is thus maintained at a minimum.

24. A mechanically operated dispensing device including first expansible chamber means in fluid communication with material to be dispensed, said first expansible chamber means comprising a plurality of substantially identical expansible chambers disposed in generally side-by-side relationship with one another, at least one second expansible chamber means in communication with the plurality of first expansible chambers for receiving material therefrom to accumulate and store the material under pressure, each said first expansible chamber having a smaller cross-sectional area than the cross-sectional area of the second expansible chamber means, whereby hydraulic force multiplication is obtained, and yet the plurality of first expansible chambers enables the second expansible chamber means to be rapidly filled with material, a discharge means in operative association with the second expansible chamber means to receive the material from the second expansible chamber means and to discharge it under pressure to a point of use, first manually operated means operatively connected with the first expansible chamber means to operate the first expansible chamber means to alternately draw material thereinto and discharge material under pressure therefrom into the second expansible chamber means, and a second manually operated means for effecting release of the pressurized material from the second expansible chamber means to a point of use.

* * * * *